US006898880B2

(12) United States Patent
Best et al.

(10) Patent No.: US 6,898,880 B2
(45) Date of Patent: May 31, 2005

(54) CLAIM TAG ASSEMBLY

(75) Inventors: Scott D. Best, Troy, MI (US); James F. Turner, Farmington Hills, MI (US)

(73) Assignee: Saxon, Inc., Ferndale, MI (US)

( * ) Notice: Subject to any disclaimer, the term of this patent is extended or adjusted under 35 U.S.C. 154(b) by 0 days.

(21) Appl. No.: 10/305,621

(22) Filed: Nov. 27, 2002

(65) Prior Publication Data

US 2003/0106250 A1 Jun. 12, 2003

Related U.S. Application Data

(60) Provisional application No. 60/339,221, filed on Dec. 11, 2001, provisional application No. 60/406,276, filed on Aug. 27, 2002, and provisional application No. 60/425,090, filed on Nov. 8, 2002.

(51) Int. Cl.[7] ..... G09F 3/10
(52) U.S. Cl. ..... 40/299.01; 40/674; 40/675
(58) Field of Search ..... 40/299.01, 673, 40/674, 593, 634, 675

(56) References Cited

U.S. PATENT DOCUMENTS

| | | | | | |
|---|---|---|---|---|---|
| 842,348 | A | | 1/1907 | Shiley | |
| 1,089,154 | A | | 3/1914 | Portmore | |
| 2,094,210 | A | | 9/1937 | Graben | |
| 3,753,305 | A | | 8/1973 | Mueh | 40/125 R |
| 3,755,934 | A | | 9/1973 | Porcher et al. | 40/2 F |
| D254,226 | S | | 2/1980 | Morse | D7/45 |
| 4,726,131 | A | | 2/1988 | Cass | |
| 4,846,501 | A | | 7/1989 | Del Grande | |
| 4,862,617 | A | | 9/1989 | Cooke, Jr. et al. | |
| D329,468 | S | | 9/1992 | Hatt | D20/22 |
| 5,299,834 | A | | 4/1994 | Kraige | 283/51 |
| 5,343,647 | A | | 9/1994 | Bulka | 40/630 |
| D358,429 | S | | 5/1995 | Ely | D20/27 |
| 5,417,458 | A | * | 5/1995 | Best et al. | 283/51 |
| 5,423,141 | A | | 6/1995 | Myles et al. | |
| 5,493,801 | A | * | 2/1996 | James | 40/642.01 |
| 5,501,491 | A | | 3/1996 | Thompson | 283/70 |
| 5,573,825 | A | * | 11/1996 | Brewster | 428/43 |
| D386,793 | S | | 11/1997 | Haas et al. | D20/27 |
| D394,882 | S | | 6/1998 | Ho | D20/42 |
| D395,680 | S | | 6/1998 | Sandy | D20/10 |
| D395,923 | S | | 7/1998 | Ely | D20/28 |
| 5,776,287 | A | | 7/1998 | Best et al. | |
| 5,863,076 | A | | 1/1999 | Warther | |
| 5,868,498 | A | | 2/1999 | Martin | 40/600 |
| 6,092,841 | A | | 7/2000 | Best et al. | |
| D432,174 | S | | 10/2000 | Stevens et al. | D20/22 |
| 6,197,396 | B1 | | 3/2001 | Hass et al. | |
| 6,209,918 | B1 | | 4/2001 | Christopherson | 283/51 |
| 6,228,451 | B1 | | 5/2001 | Boudouris et al. | |
| 6,241,287 | B1 | | 6/2001 | Best et al. | |
| 6,299,530 | B1 | | 10/2001 | Hansted et al. | 462/64 |
| 6,305,716 | B1 | * | 10/2001 | Warther et al. | 283/61 |
| 6,315,023 | B1 | | 11/2001 | King et al. | |
| 6,352,608 | B1 | | 3/2002 | Garden | |
| D456,910 | S | | 5/2002 | Clark et al. | D24/225 |
| 6,623,039 | B2 | | 9/2003 | Thompson | 283/61 |

* cited by examiner

*Primary Examiner*—S. Joseph Morano
*Assistant Examiner*—Robert J. McCarry, Jr.
(74) *Attorney, Agent, or Firm*—Howard & Howard

(57) ABSTRACT

A claim tag assembly has a first layer of card stock and a second layer of card stock with a liner sandwiched therebetween. Score lines are cut through the layers of card stock and the liner to define a first identification portion and a second identification portion. A first identifier is printed on the first identification portion for conveying a first message and a second identifier is printed on the second identification portion for conveying a second message which is identical to the first message. The first and second identification portions can then be matched after separation. The score lines further defining a card with the card being separable from the first and second identification portions. The card has at least promotional indicia and/or a coupon printed thereon for providing a marketing aspect to the claim tag assembly. Preferably, the card has a plurality of mini-coupons which can be detached from the card.

44 Claims, 11 Drawing Sheets

CLAIM TAG ASSEMBLY

RELATED APPLICATIONS

The subject patent application claims priority to and all the benefits of U.S. Provisional patent applications Ser. No. 60/339,221, filed on Dec. 11, 2001, Ser. No. 60/406,276, filed on Aug. 27, 2002, and Ser. No. 60/425,090, filed on Nov. 8, 2002.

BACKGROUND OF THE INVENTION

1. Field of the Invention

The subject invention relates to claim tag assemblies which have two identification portions and a common identifier.

2. Description of the Prior Art

Claim tag assemblies are well known and are used for various purposes in a variety of service industries. For example, claim tag assemblies are used in the automotive industry when a vehicle is given to a service department. Claim tag assemblies are also used by valets when parking a vehicle. In addition, claim tag assemblies are used in the retail industry, such as for checking packages, the service repair industry and other service industries, such as for checking coats. All of the claim tag assemblies used in any of these industries have a first identification portion that is attached to the vehicle, package, coat, or the like. The claim tag assemblies also have a second identification portion that is given to the customer. When servicing or parking a vehicle, the second identification portion is frequently attached to the keys of the vehicle. The first and second identification portions have a common identifier such that the identification portions can be matched after separation. This ensures that the customer is receiving the correct vehicle, package, coat, or the like. An example of a vehicle claim tag assembly is disclosed in U.S. Pat. No. 6,352,608.

Each of the prior art claim tag assemblies, however, do not have any promotional indicia, coupons, or the like that would encourage a customer to return to the establishment that serviced the vehicle, parked the vehicle, stored the packages, repaired the product, checked the coat, etc. Accordingly, it would be desirable to develop a claim tag assembly that adequately conveyed the necessary identifying information while simultaneously promoting an establishment.

SUMMARY OF THE INVENTION AND ADVANTAGES

A claim tag assembly comprising a first layer of material having an exterior surface and an interior surface. A liner is adhered to the interior surface of the first layer of material. A second layer of material, having an exterior surface and an interior surface, has the interior surface of the second layer of material adhered to the liner to sandwich the liner between the first and second layers of material. A plurality of score lines cut through the first layer of material, the liner, and the second layer of material to define a first identification portion and a second identification portion with the first and second identification portions being separable from each other. A first identifier is printed on at least one of the exterior surfaces of the first identification portion for conveying a first message. A second identifier is printed on at least one of the exterior surfaces of the second identification portion for conveying a second message which is identical to the first message such that the first and second identification portions can be matched after separation. The assembly is characterized by the plurality of score lines further defining a card with the card being separable from at least one of the first and second identification portions and the card having at least one of promotional indicia and a coupon printed on at least one of the exterior surfaces for providing a marketing aspect to the claim tag assembly. Preferably, the assembly is characterized by the card having a plurality of mini-coupons cut through the second layer of material such that each of the mini-coupons can be subsequently detached from the card.

Accordingly, the subject invention includes a claim tag assembly having a card with promotional indicia and/or coupons, such as mini-coupons, that would encourage a customer to return to the establishment that utilized the claim tag assembly.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
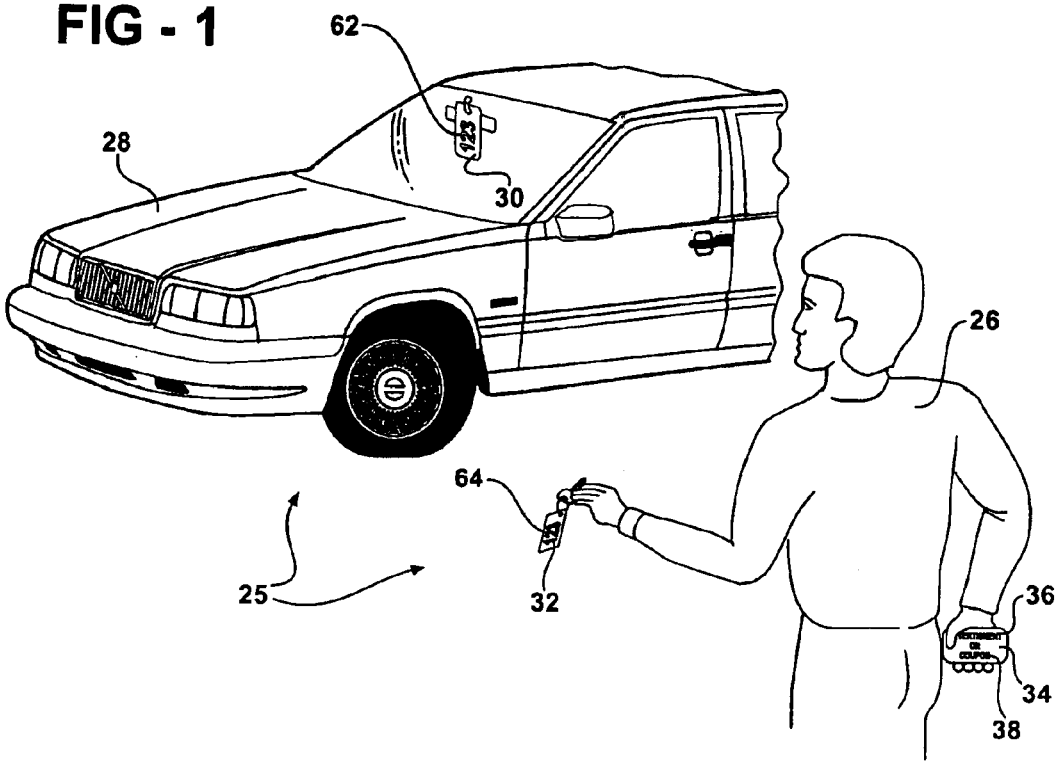
FIG. 1 is an environmental view of a claim tag assembly in accordance with the subject invention for use with a vehicle.
Figure 2:
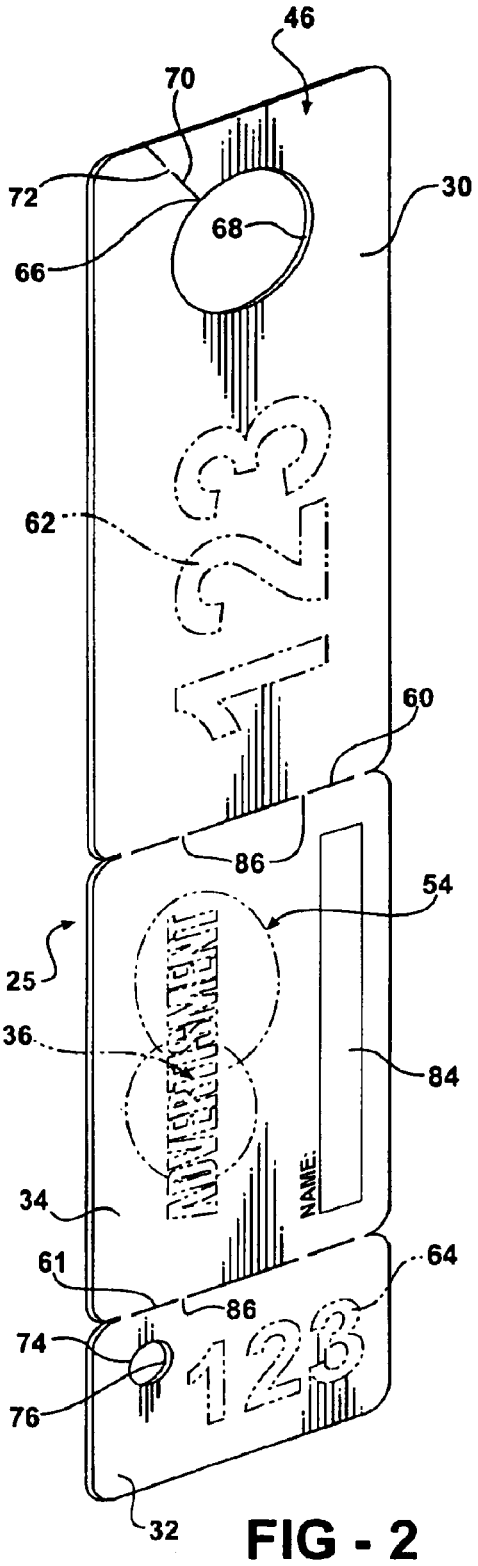
FIG. 2 is a perspective view of the claim tag assembly.
Figure 20:
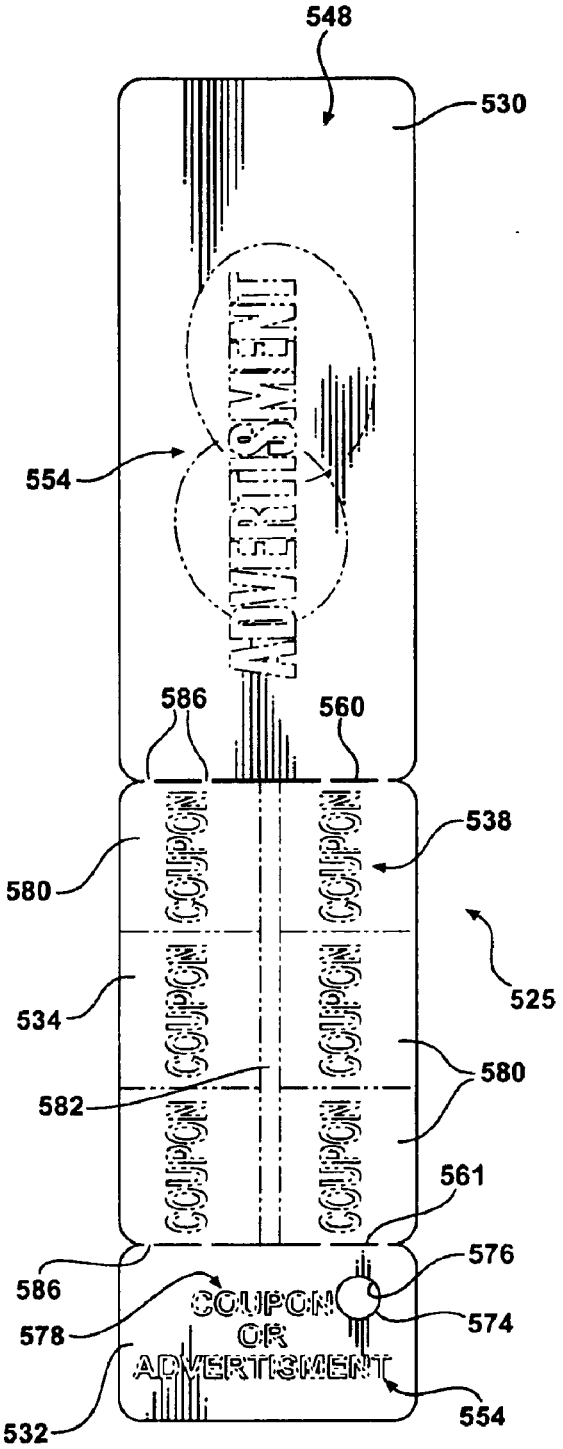
FIG. 20 is a planar view of the back of the claim tag assembly of FIG. 18.

Referring to the Figures, wherein like numerals indicate like or corresponding parts throughout the several views, a claim tag assembly is generally shown at 25 in FIGS. 1 and 2. The claim tag assembly 25 is preferably illustrated as being used by a customer 26 in conjunction with a vehicle 28. For example, the customer 26 may be giving the vehicle 28 to an automotive service department for repair or to a valet for parking. It should be appreciated that the subject invention is in no way intended to be limited to vehicle 28 applications and in fact other applications for the subject claim tag assembly 25, such as retail, repair, and other service related industries are contemplated by the applicants of the subject invention.

The claim tag assembly 25 includes a first identification portion 30 and a second identification portion 32. In the vehicle embodiment illustrated in FIG. 1, the first identification portion 30 is attached to the vehicle 28 and the second identification portion 32 is attached to the keys of the vehicle 28. The claim tag assembly 25 also includes a card 34 with the card 34 being separable from at least one of the first 30 and second 32 identification portions. As illustrated in FIG. 1, the customer 26 is holding the card 34 in his hand. The card 34 has at least one of promotional indicia 36 and a coupon 38 imprinted thereon for providing a marketing aspect to the claim tag assembly 25. The marketing aspect of the claim tag assembly 25, as provided by the card 34, encourages a customer 26 to return to the establishment that serviced the vehicle 28, parked the vehicle 28, etc.

Figure 3:
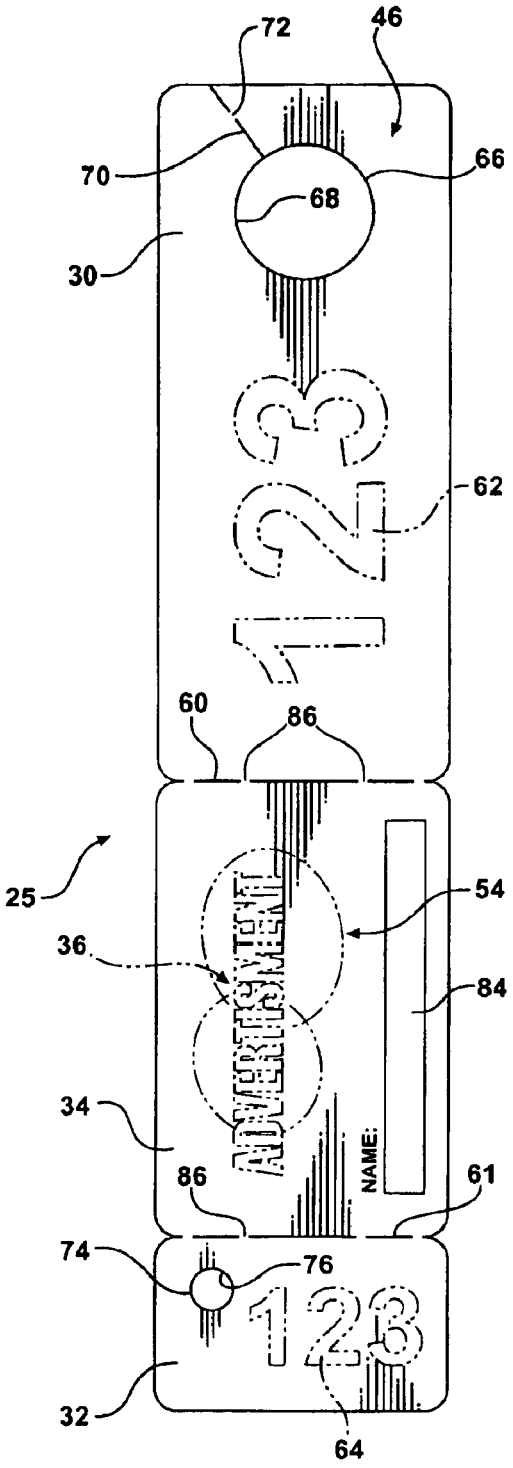
FIG. 3 is a planar view of the front of the claim tag assembly of FIG. 2.
Figure 4:
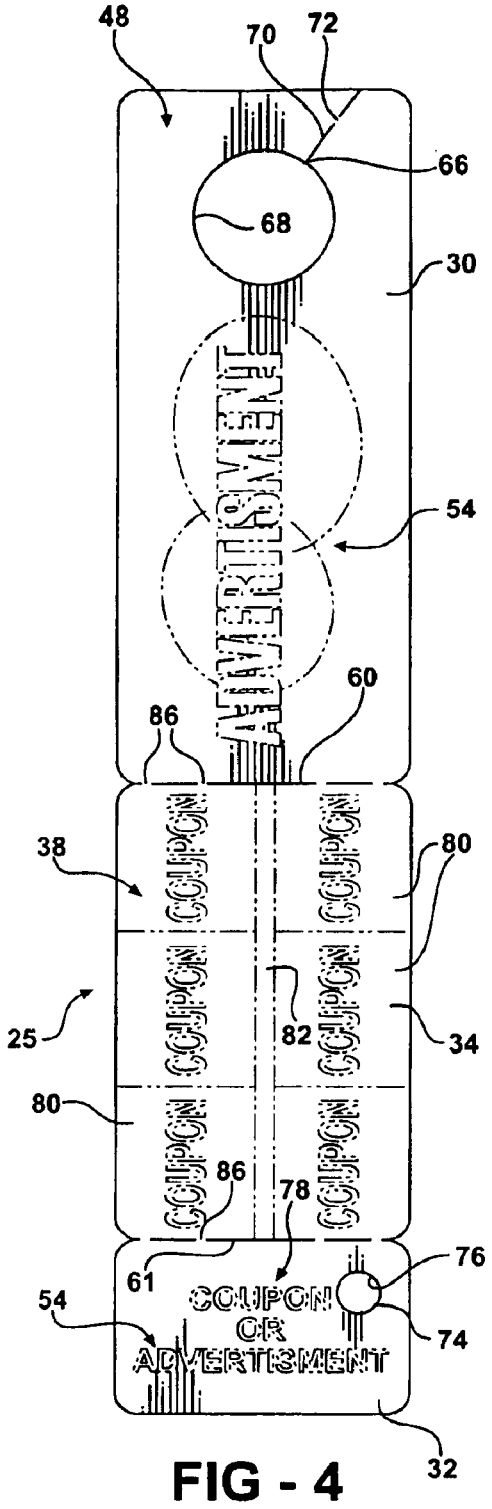
FIG. 4 is a planar view of the back of the claim tag assembly of FIG. 2.
Figure 5:
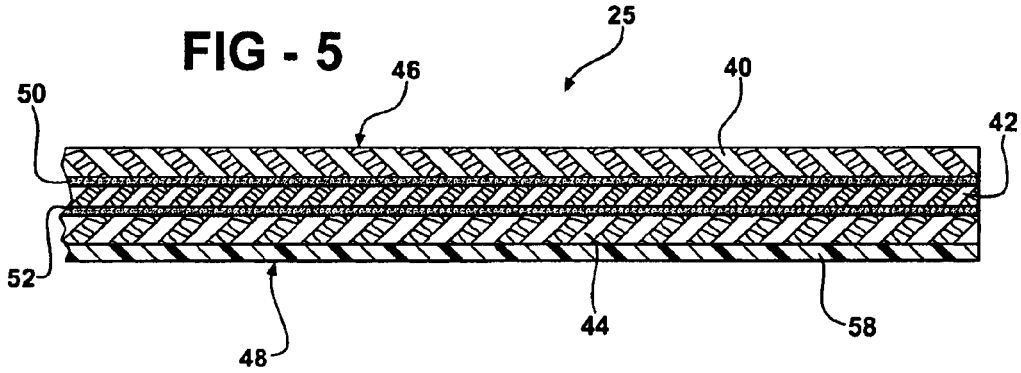
FIG. 5 is a cross-sectional view of the claim tag assembly of FIG. 2.
Figure 6:
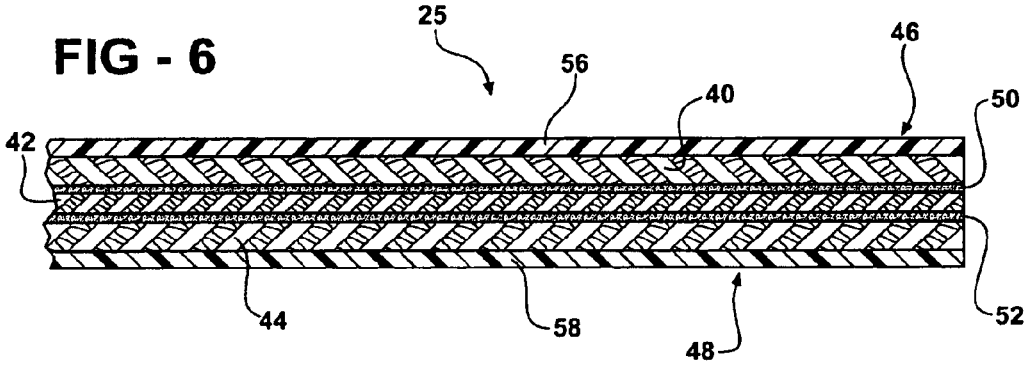
FIG. 6 is another cross-sectional view of the claim tag assembly of FIG. 2.
Figure 7:
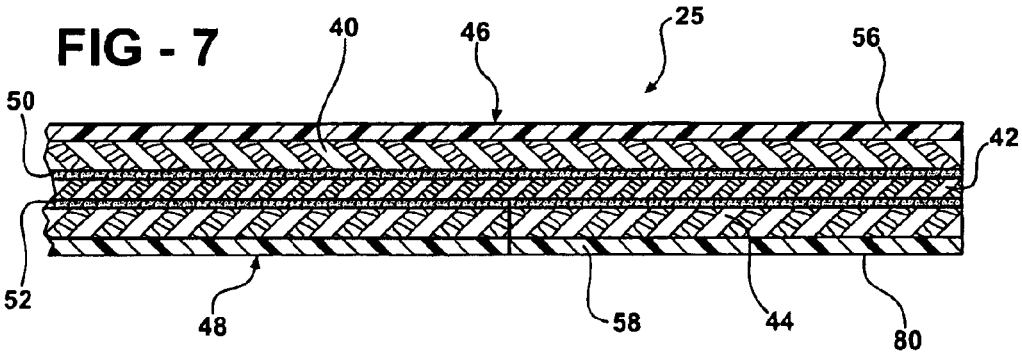
FIG. 7 is a cross-sectional view of the claim tag assembly of FIG. 2 illustrating a score line cut through a portion of the assembly.

A preferred embodiment of the claim tag assembly 25 is now discussed in greater detail with reference to FIGS. 2–7. Variations of the claim tag assembly 25, such as the ones subsequently discussed and the ones used in non-automotive applications can be made without deviating from the overall scope of the subject invention. As best shown in FIGS. 5–7, the claim tag assembly 25 comprises a first layer of material 40 having an exterior surface and an interior surface. A liner 42 is adhered to the interior surface of the first layer of material 40. A second layer of material 44 is also included, having an exterior surface and an interior surface. The interior surface of the second layer of material 44 is preferably adhered to the liner 42 to sandwich the liner 42 between the first 40 and second 44 layers of material. When the claim tag assembly 25 is constructed, the exterior surface of the first layer of material 40 becomes a front surface 46 of the claim tag assembly 25. The front surface 46 is also shown in FIGS. 2 and 3. The exterior surface of the second layer of material 44 becomes a back surface 48 of the claim tag assembly 25. The back surface 48 is also shown in FIG. 4. Preferably, the first 40 and second 44 layers of material are first 40 and second 44 layers of card stock of any suitable thickness. In addition, the liner 42 is preferably made of a clear polyester or paper material of any suitable thickness having a silicone finish on one or more sides.

A first adhesive layer 50 is disposed between the interior surface of the first layer of card stock 40 and the liner 42 to adhere the first layer of card stock 40 to the liner 42. Similarly, a second adhesive layer 52 is disposed between the interior surface of the second layer of card stock 44 and the liner 42 to adhere the second layer of card stock 44 and the liner 42. The silicone finish on one or more sides of the liner 42 allows the first 40 and/or second 44 layers of card stock, with the adhesive layer 50, 52, to be removed from the liner 42. In the most preferred embodiment, a silicone finish is disposed on a bottom side of the liner 42 such that the second layer of card stock 44 and second adhesive layer 52 can be removed. Conversely, the first layer of card stock 40 is preferably permanently adhered or "welded" to the liner 42.

As best shown in FIGS. 2–4, printed matter is imprinted on at least one of the exterior surfaces of the first 40 and second 44 layers of card stock. Hence, the printed matter, which is preferably a variety of different information messages, advertisements, logos, coupons, etc., can be disposed on either or both of the front 46 and back 48 surfaces and may be of any size, color or shape as desired by a particular vendor. Preferably, promotional areas 54 are disposed on at least one of the first identification portion 30, the second identification portion 32, and the card 34. The promotional areas 54 include printed matter imprinted on at least one of the exterior surfaces for providing a marketing aspect to the claim tag assembly 25. The promotional areas 54 with the printed matter on the card 34 define the promotional indicia 36 previously discussed. As shown in FIGS. 2 and 3, promotional printed matter or promotional indicia 36 is imprinted in the promotional area 54 on the front surface 46 of the card 34. As shown in FIG. 4, promotional printed matter is imprinted on the promotional area 54 on the back surface 48 of the first 30 and second 32 identification portions. Of course, the promotional printed matter may be imprinted in any suitable promotional area 54.

Referring back to FIGS. 5–7, a first laminate layer 56 can be adhered to the exterior surface of the first layer of card stock 40 over the printed matter for protecting the first layer of card stock 40 (the front surface 46) and any printed matter thereon. Similarly, a second laminate layer 58 is adhered to the exterior surface of the second layer of card stock 44 over the printed matter for protecting the second layer of card stock 44 (the back surface 48) and any printed matter thereon.

As shown in FIGS. 2–4, a plurality of score lines 60, 61 are cut through the first layer of material 40, the liner 42, and the second layer of material 44 to define the first identification portion 30 and the second identification portion 32 with the first 30 and second 32 identification portions being separable from each other. A first identifier 62 is printed on at least one of the exterior surfaces of the first identification portion 30 for conveying a first message. Similarly, a second identifier 64 is printed on at least one of the exterior surfaces of the second identification portion 32 for conveying a second message. The second message is identical to the first message such that the first 30 and second 32 identification portions can be matched after separation. The first 30 and second 32 identification portions therefore have a common identifier 60, 62 to ensure that the customer 26 is receiving the correct vehicle 28, package, coat, or the like. Preferably, as shown in FIGS. 1, 2, and 3 the first identifier 62 and second identifier 64 are printed on the front surface 46. Even more preferably, the first 62 and second 64 identifiers are further defined as the same numerical sequence, such as 1 2 3. It should be appreciated that the first 61 and second 62 identifiers may be of any suitable number, design, or configuration so long as a common message is conveyed. In addition, it should be appreciated by those skilled in the art that the common first 61 and second 62 identifiers will be unique for each claim tag assembly 25. Hence, for example, each different vehicle 28 at a service department can be easily identified and located.

In the preferred embodiment of FIG. 1, the first identification portion 30 is further defined as a vehicle identification portion 30 for being selectively mounted within a vehicle 28.

The first or vehicle identification portion 30 includes a hanging section 66 defining an opening 68 for mounting the vehicle identification portion 30 to a rear view mirror of the vehicle 28. The first or vehicle identification portion 30 also includes a slit 70 extending from the opening 68 for allowing access to the opening 68. A connection point 72 is disposed within the slit 70 such that the hanging section 66 remains interconnected until manually manipulated by the customer 26. Of course, the first vehicle identification portion 30 may be hung or mounted to any other suitable portion of the vehicle 28 without deviating from the scope of the subject invention. Preferably, the front surface 46 of the vehicle identification portion 30 faces outwardly from the vehicle 28 such that the customer 26 or other user may view the first identifier 62, i.e. the first message. The back surface 48 of the vehicle identification portion 30 can include promotional printed matter such as the particular dealership, service department, manufacturer, etc., (See FIG. 4).

Also in the preferred embodiment of FIG. 1, the second identification portion 32 is further defined as a key identification portion 32 for being selectively mounted to a key of a vehicle 28. The second or key identification portion 32 includes a connection section 74 defining an opening 76 for mounting the key identification portion 32 to the key. Preferably, the front surface 46 of the key identification portion 32 clearly displays the second identifier 62, i.e. the second message, such that the customer 26 or other user can match this second message with the first message. As shown in FIG. 4, a coupon area 78 is disposed on the back surface 48 the key identification portion 32. It should be appreciated that coupon areas 78 can be disposed on other front 46 or back 48 surfaces of the first 30 (vehicle) or second 32 (key) identification portions without deviating from the scope of the subject invention.

The plurality of score lines 60, 61 further define the card 34 with the card 34 being separable from the first 30 and second 32 identification portions. As shown in FIGS. 4 and 7, the card 34 has a plurality of mini-coupons 80 cut through the second layer of material 44, i.e., the back surface 48, such that each of the mini-coupons 80 can be subsequently detached from the card 34. Even more preferably, each of the mini-coupons 80 includes a portion of the second layer of card stock 44 and a portion of the second adhesive layer 52. The structural integrity of the card 34, with the liner 42 and first layer of card stock 40, is maintained even after the mini-coupons 80 are removed. The specific construction is preferably of the type disclosed in U.S. Pat. No. 5,417,458 to Best et al., which is herein incorporated by reference.

An information area 82 is positioned adjacent the mini-coupons 80 on the card 34 for conveying selected information to a user, such as company information, patent numbers, etc. As shown in FIG. 4, the information area 82 is positioned centrally to separate two rows of mini-coupons 80. As appreciated, the shape, size, or configuration of the mini-coupons 80 can be varied without deviating from the scope of the subject invention. In fact, a number of alternative mini-coupon configurations are illustrated in the alternative embodiments of FIGS. 9–16.

As best shown in FIGS. 2 and 3, a customer name area 84 is disposed on the front surface 46 of the card 34 in order to personalize the card 34. The first adhesive buyer 50 may not be applied to the front surface 46 of card 34, as shown in FIG. 5, such that the customer 26 can write within the name area 84 covered. Further, a promotional area 54 is disposed on at least one of the exterior surfaces of the card 34 with the promotional indicia 36 imprinted within the promotional area 54. Preferably, the top surface of the card 34 includes promotional indicia 36 such as logos, messages, or advertisements. In addition, the card 34 preferably has a rectangular configuration similar in size to a standard credit card.

In the embodiment of FIGS. 2–4, the plurality of score lines 60, 61 is further defined as a first series of score lines 60 cut between the first identification portion 30 and the card 34. In addition, the plurality of score lines 60, 61 is further defined as a second series of score lines 61 cut between the card 34 and the second identification portion 32. Hence, the claim tag assembly 25 has a substantially rectangular configuration with the first identification portion 30 on top, the second identification portion 32 on the bottom, and the card 34 connected therebetween.

A plurality of connection points 86 are disposed between the score lines 60, 61 for maintaining interconnection between the first identification portion 30, the second identification portion 32, and the card 34, see FIGS. 2–4. The connection points 86 are areas of the claim tag assembly 25 in which the score lines 60, 61 are not formed. As shown in FIG. 1, the connection points 86 may be broken to separate the first identification portion 30, the second identification portion 32, and the card 34 from each other.

The preferred method of using the claim tag assembly 25 includes removing the key identification portion 32 and attaching this key identification portion to a key ring of the vehicle keys. Then the vehicle identification portion 30, with the card 34, is hung on the rear view mirror in the vehicle 28. After the vehicle 28 is serviced, the vehicle identification portion 30 remains in the vehicle 28 such that the customer 26 of the vehicle 28 may sever the card 34 from the vehicle identification portion 30. The vehicle identification portion 30 can then be discarded or used as a souvenir. The card 34 and/or mini-coupons 80 can be used during return visits to the dealership and/or service department. In particular, the mini-coupons 80 may be peeled off individually and redeemed to encourage the vehicle owner to return to the advertised dealership or service department. Of course, the method of using the claim tag assembly 25 may vary depending upon the embodiment of the claim tag assembly 25.

Figure 8:
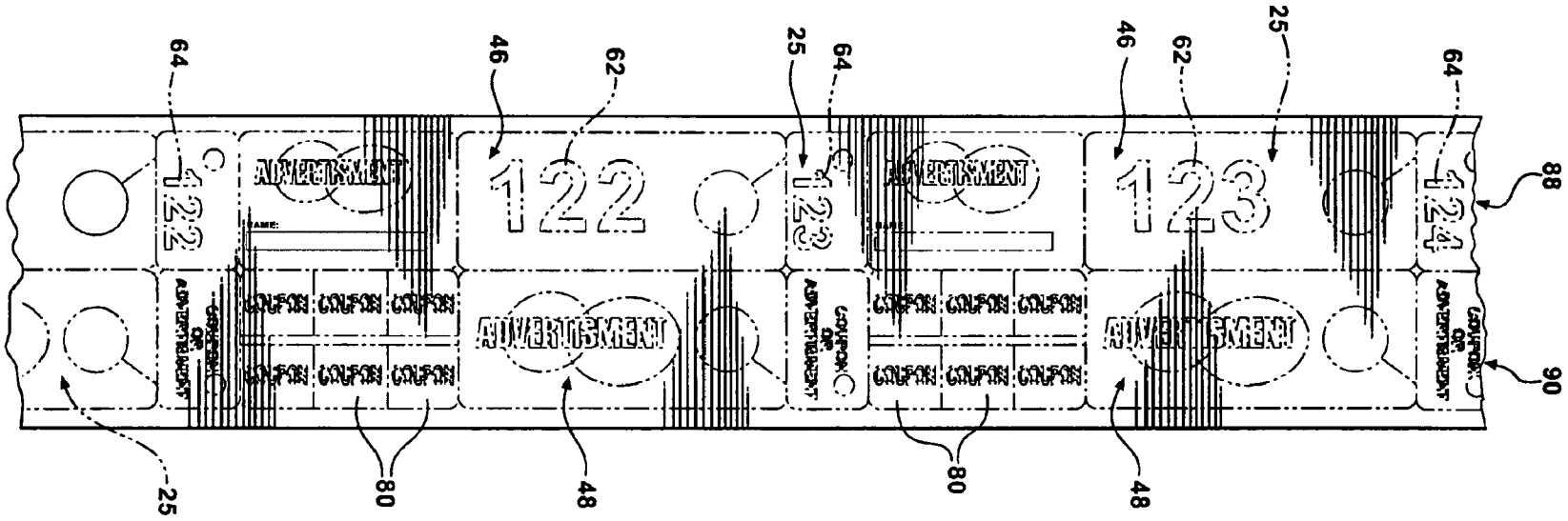
FIG. 8 is a top view of a series of claim tag assemblies during a manufacture thereof.

Referring to FIG. 8, one preferred method of manufacturing the claim tag assembly 25 is now discussed in detail. The manufacture of the claim tag assembly 25 initially begins with a single continuous sheet of card stock. The initial layout of the claim tag assembly 25 has the front 46 and back 48 surfaces of the claim tag assembly 25 being attached together and initially facing upward. Both the front 46 and back 48 surfaces include the single continuous sheet of card stock with a continuous adhesive layer and a continuous release film adhered to an underside thereof.

The sheet of card stock is fed into a printing station (not shown) which prints the desired printed matter or indicia on the upward facing surfaces of the stock in two parallel rows at the same time. As discussed above, the indicia may be any desirable logos, messages, advertisements or the like. A certain amount of exterior material is disposed around the perimeter of the rows. The first 62 and second 64 identifiers are also printed on the sheet of stock. As illustrated, the first 62 and second 64 identifiers are sequentially printed on a series of substantially identical claim tag assemblies 25, i.e., 1 2 2; 1 2 3; and 1 2 4. The identifiers 62, 64 are therefore unique to each of the claim tag assemblies 25. This sequential printing is accomplished by a variable printing apparatus as is known in the art.

The parallel rows define a first strip 88 and a second strip 90 wherein the first strip 88 becomes the front surface 46 of the claim tag assembly 25 and the second strip 90 becomes the back surface 48 of the claim tag assembly 25. In other words, the front surface 46 of FIG. 3 is illustrating the first strip 88 and the back surface 48 of FIG. 4 is illustrating the second strip 90. As appreciated, the strips 88, 90 may be of any width or design to coordinate with the desired shape of the claim tag assembly 25. In fact, different sized strips 88, 90 will be required to manufacture the claim tag assemblies 25 of the alternative embodiments of FIGS. 9–16. A laminating device (not shown) can apply the clear laminate layer to the top surface of the stock on either or both of the strips 88, 90 for viewing the printed matter. In the embodiment shown in FIG. 5, the laminate will not be applied to the first strip 88.

A cutting device (not shown) separates the continuous sheet of stock into the first 88 and second strips 90. The second strip 90 is then inverted and the liner is removed from the first strip 88. The silicone finish of the liner allows the liner to be removed from the adhesive layer without removing the adhesive or damaging the sheet of stock. The first 88 and second strips 90 are aligned and the adhesive layer of the first strip 88 is moved into a bonded relationship with the liner of the second strip 90. As appreciated, the printed, matter of the first strip 88 should align with the printed matter of the second strip 90. The continuous sheet of stock having printed matter on the upward facing surfaces in two parallel rows has been transformed into a continuous series of two sided claim tag assemblies 25. The first strip 88 is now the front surface 46 of the claim tag assembly 25 and the second strip 90 is now the back surface 48 of the claim tag assembly 25. In other words, there are now a plurality of interconnected claim tag assemblies 25 with each assembly having substantially the same printed matter disposed on each exterior surface of the first and second layers of material for creating the series of substantially identical claim tag assemblies 25.

Another method of manufacturing the claim tag assembly 25 includes beginning with a continuous sheet of laminated material defining continuous first 40 and second 44 layers of material sandwiching a continuous liner 42 therebetween. As discussed above, the continuous liner 42 can have a silicone finish on one or more sides. First 50 and second 52 adhesive layers are disposed between the continuous first 40 and second 44 layers of material and the continuous liner 42.

The continuous sheet of laminated material is fed into a printing station which prints the desired printed matter or indicia on one or both of the first 40 and 44 layers of material. The printed matter may be any suitable identifier, logo, message, advertisement, or the like as discussed above. A laminating device can apply a clear laminate to one or both of the first 40 and second 44 layers of material.

The continuous first layer of material 40 becomes the first surface 46 of the claim tag assembly 25. Similarly, the continuous second layer of material 44 becomes the back surface 48 of the claim tag assembly. There are now a plurality of interconnected claim tag assemblies 25 with each assembly having substantially the same printed matter on one or both of the front 46 and back 48 surfaces for creating the series of substantially identical claim tag assemblies 25.

Irrespective of the method used above, the back surface 48 of the claim tag assembly 25 is preferably scored by a scoring wheel (not shown) to form a perimeter of the mini-coupons 80. The scoring is substantial enough such that the mini-coupons 80 may be removed without affecting the adhesion of the remaining mini-coupons 80. Preferably, the scoring passes through the laminate layer, card stock, and adhesive layer of the second strip 90. The scoring does not, however, sever the liner of the second strip 90 nor the card stock of the first strip 88. Each mini-coupon is therefore preferably formed of the laminate layer, card stock, and adhesive layer of the second strip 90. As appreciated, the first and second identification portions and/or card will preferably maintain the laminate layer, card stock, and adhesive layer of the first strip 88 and the release film of the second strip 90, thereby ensuring their structural integrity.

The series of claim tag assemblies 25 passes under a punch wheel (not shown) for removing any exterior material from the bonded first 88 and second strips 90. The punch wheel also creates the score lines between the card, the vehicle identification portion, and the key identification portion. Hence, the punch wheel scores through the entire thickness of the claim tag assembly 25 to outline the card and identification portions. The plurality of connection points are retained such that the card and identification portions remain loosely attached to each other.

Figure 9:
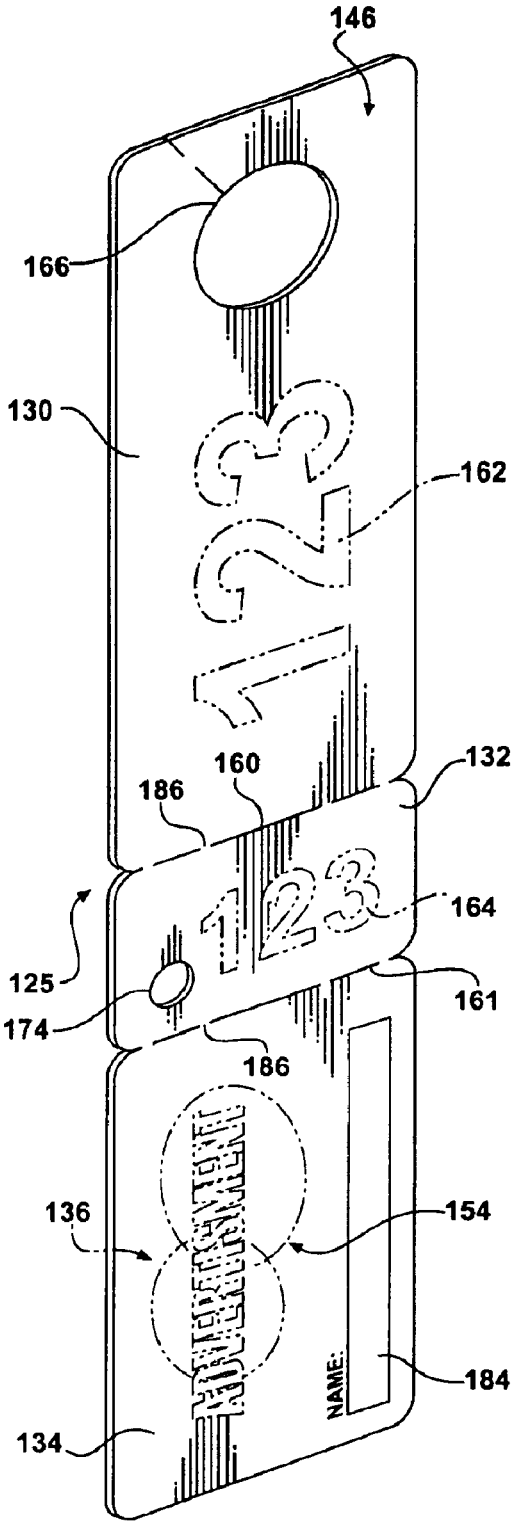
FIG. 9 is a perspective view of an alternative embodiment of the claim tag assembly.
Figure 10:
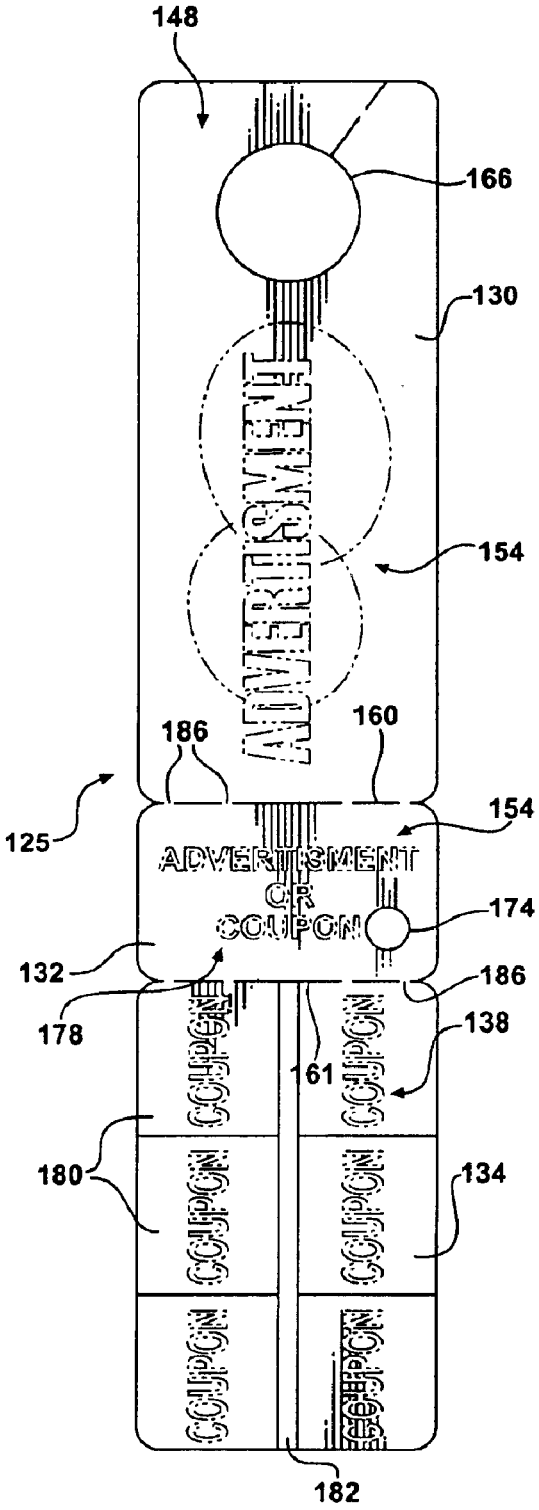
FIG. 10 is a planar view of the back of the claim tag assembly of FIG. 9.

Referring to FIGS. 9 and 10, an alternative embodiment of the claim tag assembly is disclosed wherein like numerals increased by 100 indicate like or corresponding parts. In this alternative embodiment, the claim tag assembly 125 has the second identification portion 132 being disposed between the first identification portion 130 and the card 134. Hence, the plurality of score lines 160, 161 is further defined as a first series of score lines 160 cut between the first identification portion 130 and the second identification portion 132. In addition, the plurality of score lines 160, 161 is further defined as a second series of score lines 161 cut between the second identification portion 132 and the card 134. The second identification portion 132 is also turned upside down in comparison to the second identification portion 32 of FIGS. 2–4. The remaining aspects of the claim tag assembly 125 in FIGS. 9 and 10 are substantially the same as the claim tag assembly 25 in FIGS. 2–4.

Figure 11:
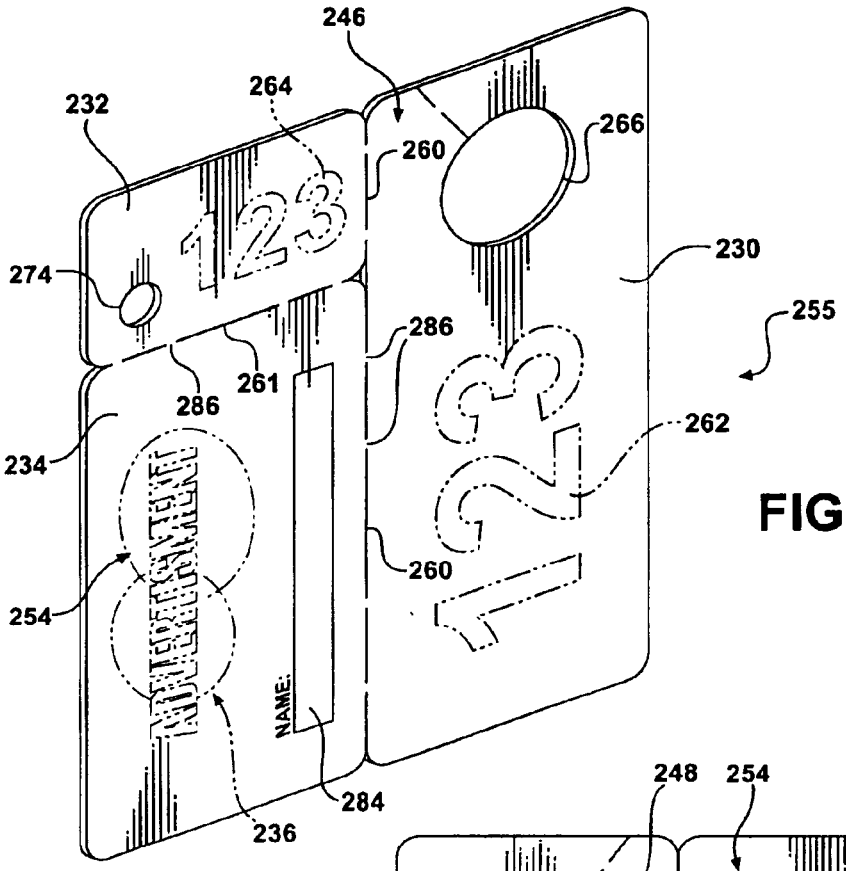
FIG. 11 is a perspective view of another alternative embodiment of the claim tag assembly.
Figure 12:
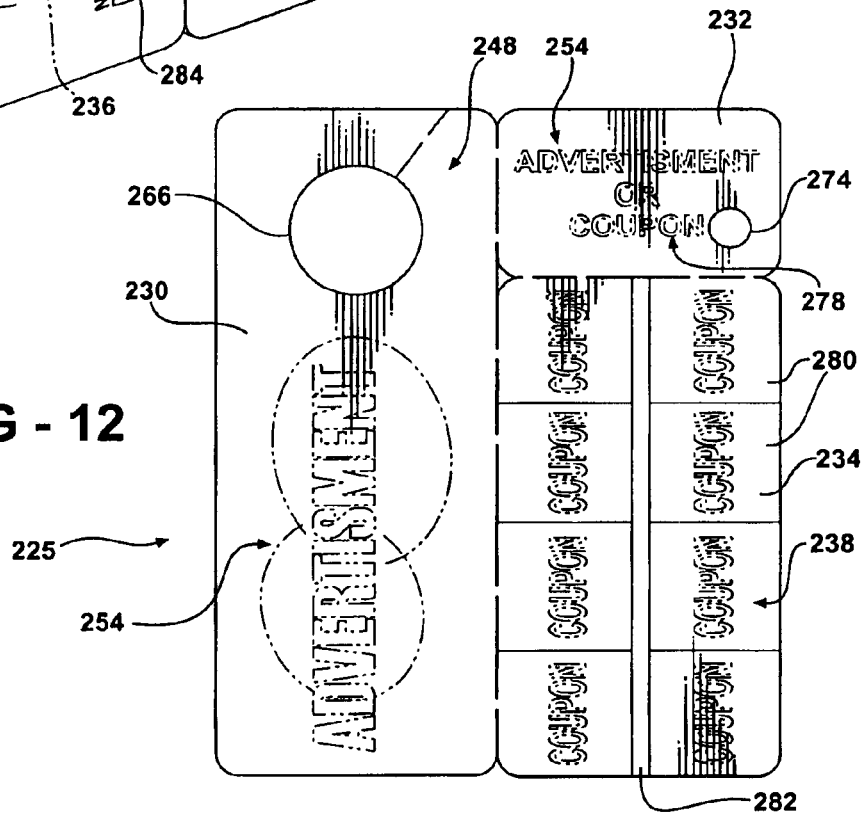
FIG. 12 is a planar view of the back of the claim tag assembly of FIG. 11.

Referring to FIGS. 11 and 12, yet another alternative embodiment of the claim tag assembly is shown wherein like numerals increased by 200 indicate like or corresponding parts. In this embodiment, the claim tag assembly 225 has both the second identification portion 232 and card 234 being mounted to a side of the first identification portion 230. Hence, the claim tag assembly 225 of FIGS. 11 and 12 is wider than the claim tag assembly 25 of FIGS. 2–4. In addition, the first series of score lines 260 is cut between the first identification portion 230 and the card 234 as well as the first identification portion 230 and the second identification portion 232. The second series of score lines 261 extends transversely from the first series of score lines 260. The back surface 248 of the card 234 also includes additional mini-coupons 280, see FIG. 12. The remaining aspects of the claim tag assembly 225 of FIGS. 11 and 12 are substantially the same as the claim tag assembly 25 of FIGS. 2–4.

Figure 13:
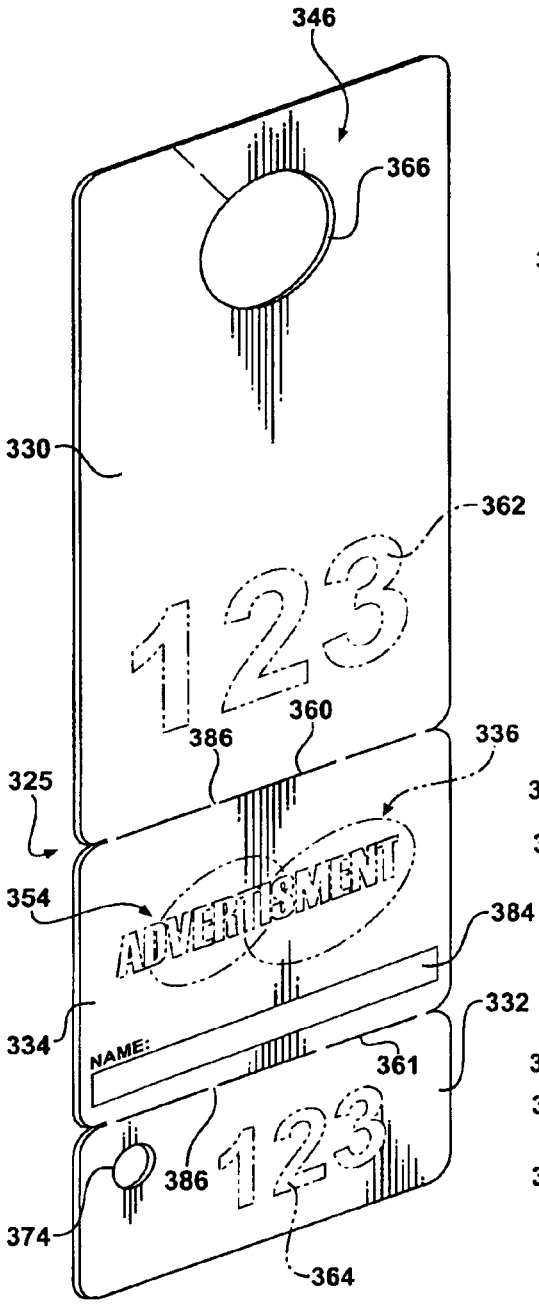
FIG. 13 is a perspective view of yet another alternative embodiment of the claim tag assembly.
Figure 14:
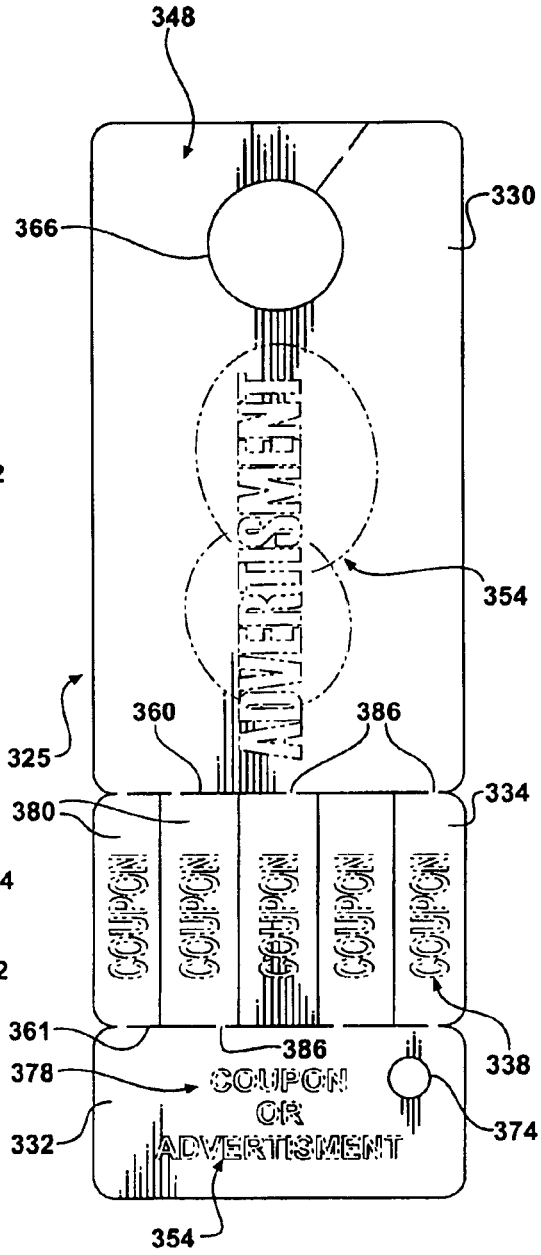
FIG. 14 is a planar view of the back of the claim tag assembly of FIG. 13.

Referring to FIGS. 13 and 14, another alternative embodiment is shown wherein like numerals increased by 300 indicate like or corresponding parts. In this embodiment, the claim tag assembly 325 has the card 334 turned sideways. This creates a shorter yet wider claim tag assembly 325 as compared to the claim tag assembly 25 of FIGS. 2–4. In addition, the mini-coupons 380 extend across the entire width of the card 334 and the information area is removed. As with the claim tag assembly 25 of FIGS. 2–4, the card 334 is formed between the first 330 and second 332 identification portions. The remaining aspects of the claim tag assembly 325 of FIGS. 13 and 14 are likewise substantially the same as the claim tag assembly 25 of FIGS. 2–4.

Figure 15:
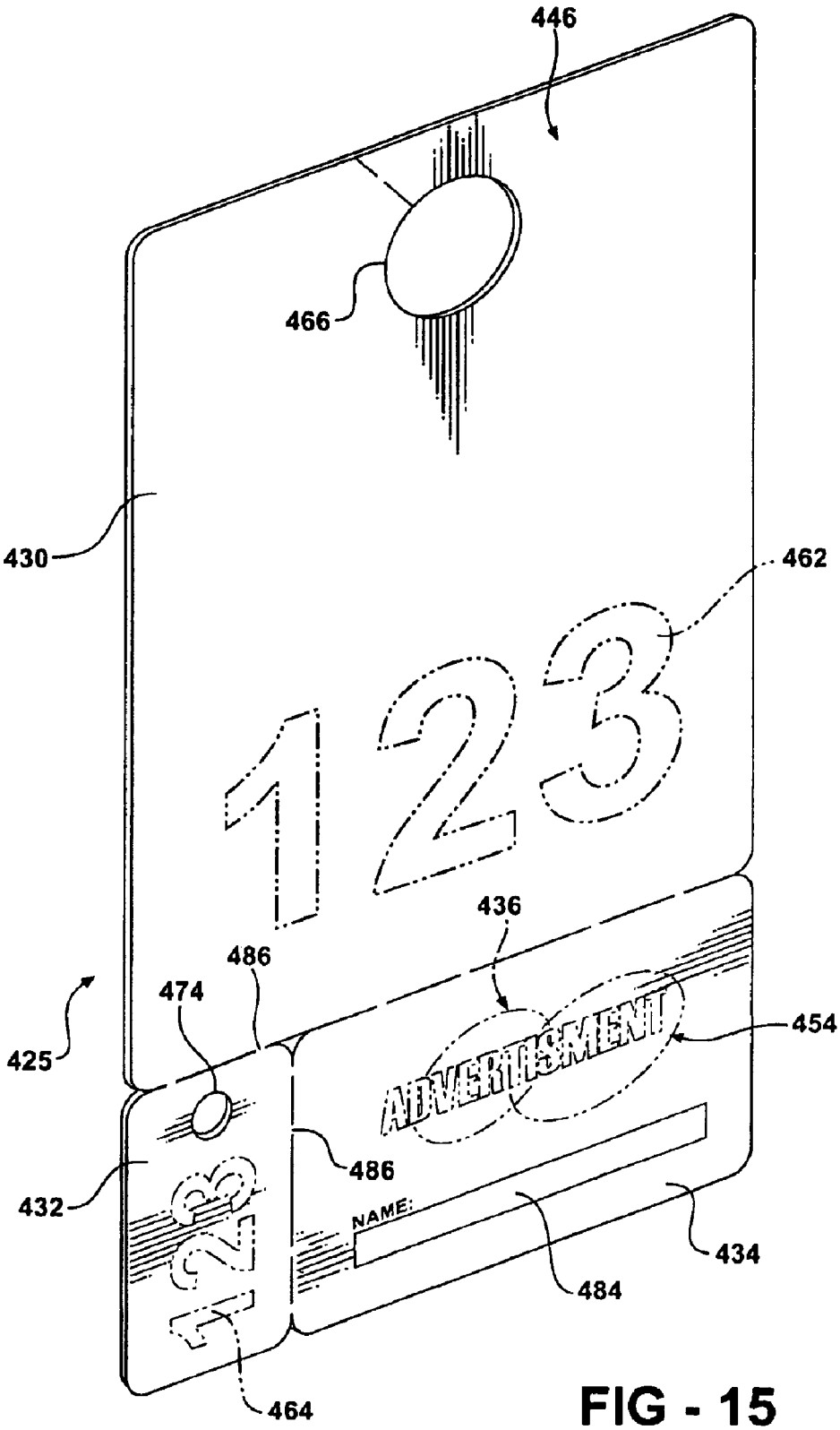
FIG. 15 is a perspective view of another alternative embodiment of the claim tag assembly.
Figure 16:
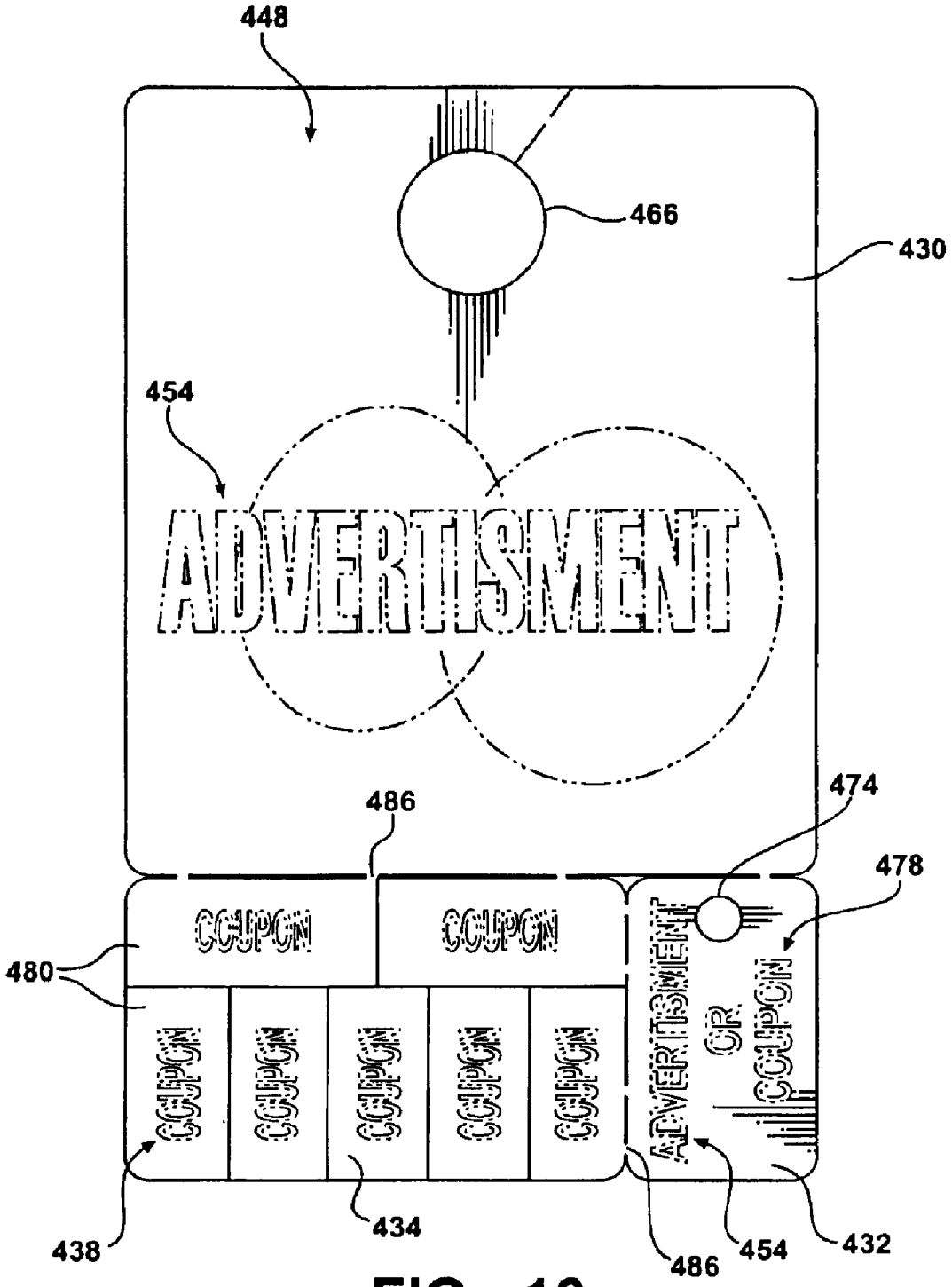
FIG. 16 is a planar view of the back of the claim tag assembly of FIG. 15.
Figure 18:
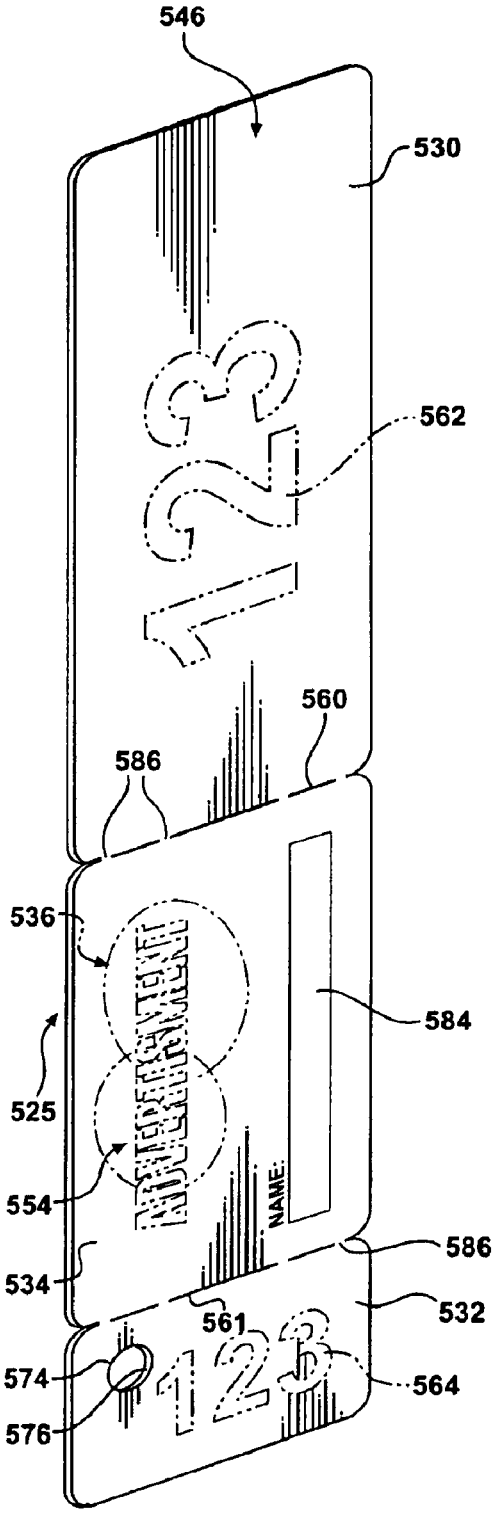
FIG. 18 is a perspective view of the alternative claim tag assembly of FIG. 17.
Figure 19:
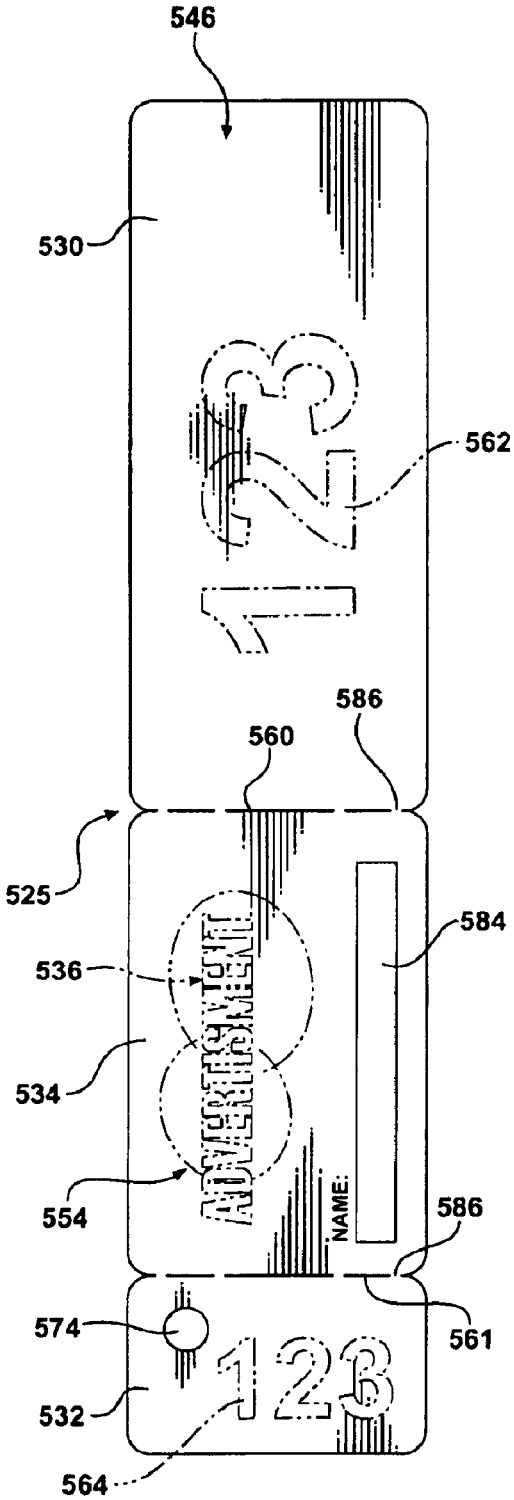
FIG. 19 is a planar view of the front of the claim tag assembly of FIG. 18.

Turning to FIGS. 15 and 16, this alternative embodiment has like numerals increased by 400 to indicate like or corresponding parts. In this embodiment, the claim tag assembly 425 has both the second identification portion 432 and card 434 turned sideways. In addition, the second identification portion 432 is mounted to a side of the card 434. This creates a very wide claim tag assembly 425 as compared to the claim tag assembly 25 of FIGS. 2–4. As shown in FIG. 16, there is yet another configuration of the mini-coupons 480 wherein some mini-coupons 480 extend transversely from the others. The remaining aspects of the claim tag assembly 425 of FIGS. 15 and 16 are substantially the same as the claim tag assembly 25 of FIGS. 2–4.

Figure 17:
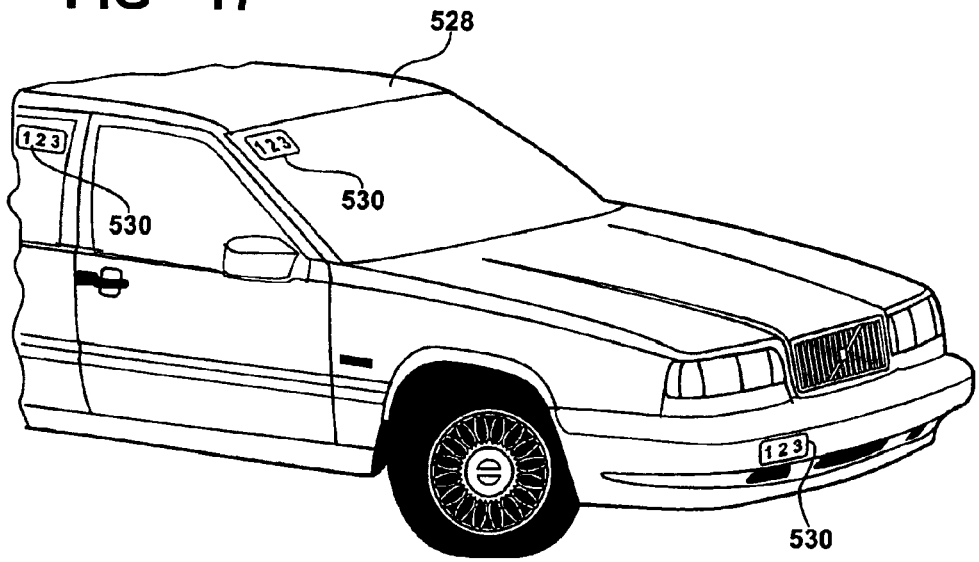
FIG. 17 is an environmental view of yet another alternative claim tag assembly for use with a vehicle.

Referring to FIGS. 17–20, another embodiment of the claim tag assembly for use with a vehicle is disclosed, wherein like numerals increased by 500 indicate like or corresponding parts. In this embodiment, the hanging section of the claim tag assembly 525 of the first identification portion 530 is eliminated. In other words, the first identification portion 530 does not include an opening or a slit for mounting the first identification portion 530. Preferably, the claim tag assembly 525 incorporates a structure which will allow the first identification portion 530 to be adhered to the vehicle 528, package, product, or the like. For example, as illustrated in FIG. 17, the first identification portion 530 may be adhered to the bumper, windshield, or window of the vehicle 528. The structure of the claim tag assembly 525 may be of any suitable design such as replacing the first and/or second layer of card stock with a layer of adhesive coated film. The adhesive coated film creates a sticker like substrate for the claim tag assembly 525. The remaining aspects of the claim tag assembly 525 of FIGS. 17–20 are substantially the same as the claim tag assembly 25 of FIGS. 2–4.

Obviously, many modifications and variations of the present invention are possible in light of the above teachings and the invention may be practiced otherwise than as specifically described within the scope of the appended claims.

What is claimed is:

1. A claim tag assembly comprising:

a first layer of material having an exterior surface and an interior surface;

a liner adhered to said interior surface of said first layer of material;

a second layer of material having an exterior surface and an interior surface with said interior surface of said second layer of material adhered to said liner to sandwich said liner between said first and second layers of material;

a plurality of score lines cut through said first layer of material, said liner, and said second layer of material to define a first identification portion and a second identification portion with said first and second identification portions being separable from each other;

a first identifier printed on at least one of said exterior surfaces of said first identification portion for conveying a first message; and a second identifier printed on at least one of said exterior surfaces of said second identification portion for conveying a second message which is identical to said first message such that said first and second identification portions can be matched after separation;

said assembly characterized by said plurality of score lines further defining a card with said card being separable from at least one of said first and second identification portions and said card having a plurality of mini-coupons cut through said second layer of material such that each of said mini-coupons can be subsequently detached from said card.

2. An assembly as set forth in claim 1 wherein said first and second layers of material are further defined as first and second layers of card stock, respectively.

3. An assembly as set forth in claim 2 further including a first adhesive layer disposed between said interior surface of said first layer of card stock and said liner to adhere said first layer of card stock to said liner, and further including a second adhesive layer disposed between said interior surface of said second layer of card stock and said liner to adhere said second layer of card stock and said liner.

4. An assembly as set forth in claim 3 further including printed matter imprinted on at least one of said exterior surfaces of said first and second layers of card stock.

5. An assembly as set forth in claim 4 further including a first laminate layer adhered to said exterior surface of said first layer of card stock over said printed matter for protecting said first layer of card stock and any printed matter thereon.

6. An assembly as set forth in claim 4 further including a second laminate layer adhered to said exterior surface of said second layer of card stock over said printed matter for protecting said second layer of card stock and any printed matter thereon.

7. An assembly as set forth in claim 3 wherein each of said mini-coupons includes a portion of said second layer of card stock and a portion of said second adhesive layer.

8. An assembly as set forth in claim 1 further including promotional areas on at least one of said first identification portion, said second identification portion, and said card with said promotional areas having printed matter imprinted on at least one of said exterior surfaces for providing a marketing aspect to said claim tag assembly.

9. An assembly as set forth in claim 1 wherein said first and second identifiers are further defined as the same numerical sequence.

10. An assembly as set forth in claim 1 further including a plurality of connection points disposed between said score lines for maintaining interconnection between said first identification portion, said second identification portion, and said card wherein said connection points may be broken upon separation of said first identification portion, said second identification portion, and said card from each other.

11. An assembly as set forth in claim 1 wherein said first identification portion is further defined as a vehicle identification portion for being selectively mounted within a vehicle.

12. An assembly as set forth in claim 11 wherein said second identification portion is further defined as a key identification portion for being selectively mounted to a key of a vehicle.

13. An assembly as set forth in claim 1 wherein said first identification portion includes a hanging section defining an opening for mounting said first identification portion.

14. An assembly as set forth in claim 13 wherein said first identification portion includes a slit extending from said opening for allowing access to said opening.

15. An assembly as set forth in claim 1 wherein said second identification portion includes a connection section defining an opening for mounting said second identification portion.

16. An assembly as set forth in claim 1 further including a coupon area disposed on at least one of said first and second identification portions.

17. An assembly as set forth in claim 1 further including a customer name area disposed on said card.

18. An assembly as set forth in claim 17 further including a information area positioned adjacent said mini-coupons on said card for conveying selected information to a user.

19. An assembly as set forth in claim 1 wherein said plurality of score lines is further defined as a first series of score lines cut between said first identification portion and said card.

20. An assembly as set forth in claim 19 wherein said plurality of score lines is further defined as a second series of score lines cut between said card and said second identification portion.

21. An assembly as set forth in claim 20 wherein said first series of score lines is further cut between said first identification portion and said second identification portion.

22. An assembly as set forth in claim 1 wherein said plurality of score lines is further defined as a first series of score lines cut between said first identification portion and said second identification portion.

23. An assembly as set forth in claim 22 wherein said plurality of score lines is further defined as a second series of score lines cut between said second identification portion and said card.

24. An assembly as set forth in claim 1 further including a plurality of interconnected claim tag assemblies with each assembly having substantially the same printed matter disposed on each exterior surface of said first and second layers of material for creating a series of substantially identical claim tag assemblies.

25. An assembly as set forth in claim 24 wherein said first and second identifiers are sequentially printed on said series of substantially identical claim tag assemblies such that said identifiers are unique to each of said claim tag assemblies.

26. A claim tag assembly comprising:

a first layer of material having an exterior surface and an interior surface;

a liner adhered to said interior surface of said first layer of material;

a second layer of material having an exterior surface and an interior surface with said interior surface of said second layer of material adhered to said liner to sandwich said liner between said first and second layers of material;

a plurality of score lines cut through said first layer of material, said liner, and said second layer of material to define a first identification portion and a second identification portion with said first and second identification portions being separable from each other;

a first identifier printed on at least one of said exterior surfaces of said first identification portion for conveying a first message; and a second identifier printed on at least one of said exterior surfaces of said second identification portion for conveying a second message which is identical to said first message such that said first and second identification portions can be matched after separation;

said assembly characterized by said plurality of score lines further defining a card with said card being separable from at least one of said first and second identification portions and said card having at least one of promotional indicia and a coupon printed on at least one of said exterior surfaces for providing a marketing aspect to said claim tag assembly.

27. An assembly as set forth in claim 26 wherein said card further includes a plurality of mini-coupons cut through said second layer of material such that each of said mini-coupons can be subsequently detached from said card.

28. An assembly as set forth in claim 26 further including a promotional area on at least one of said exterior surfaces of said card with said promotional indicia imprinted within said promotional area.

29. An assembly as set forth in claim 26 wherein said first and second layers of material are further defined as first and second layers of card stock, respectively.

30. An assembly as set forth in claim 29 further including a first adhesive layer disposed between said interior surface of said first layer of card stock and said liner to adhere said first layer of card stock to said liner, and further including a second adhesive layer disposed between said interior surface of said second layer of card stock and said liner to adhere said second layer of card stock and said liner.

31. An assembly as set forth in claim 30 further including printed matter imprinted on at least one of said exterior surfaces of said first and second layers of card stock.

32. An assembly as set forth in claim 31 further including a first laminate layer adhered to said exterior surface of said first layer of card stock over said printed matter for protecting said first layer of card stock and any printed matter thereon and a second laminate layer adhered to said exterior surface of said second layer of card stock over said printed matter for protecting said second layer of card stock and any printed matter thereon.

33. An assembly as set forth in claim 32 wherein said card further includes a plurality of mini-coupons cut through said second layer of material such that each of said mini-coupons can be subsequently detached from said card.

34. An assembly as set forth in claim 33 wherein each of said mini-coupons includes a portion of said second layer of card stock and a portion of said second adhesive layer.

35. An assembly as set forth in claim 26 further including promotional areas on at least one of said first identification portion and said second identification portion with said promotional areas having printed matter imprinted on at least one of said exterior surfaces for providing a further marketing aspect to said claim tag assembly.

36. An assembly as set forth in claim 26 wherein said first and second identifiers are further defined as the same numerical sequence.

37. An assembly as set forth in claim 26 further including a plurality of connection points disposed between said score lines for maintaining interconnection between said first identification portion, said second identification portion, and said card wherein said connection points may be broken upon separation of said first identification portion, said second identification portion, and said card from each other.

38. An assembly as set forth in claim 26 wherein said plurality of score lines is further defined as a first series of score lines cut between said first identification portion and said card.

39. An assembly as set forth in claim 38 wherein said plurality of score lines is further defined as a second series of score lines cut between said card and said second identification portion.

40. An assembly as set forth in claim 39 wherein said first series of score lines is further cut between said first identification portion and said second identification portion.

41. An assembly as set forth in claim 26 wherein said plurality of score lines is further defined as a first series of score lines cut between said first identification portion and said second identification portion.

42. An assembly as set forth in claim 41 wherein said plurality of score lines is further defined as a second series of score lines cut between said second identification portion and said card.

43. An assembly as set forth in claim 26 further including a plurality of interconnected claim tag assemblies with each assembly having substantially the same printed matter disposed on each exterior surface of said first and second layers of material for creating a series of substantially identical claim tag assemblies.

44. An assembly as set forth in claim 43 wherein said first and second identifiers are sequentially printed on said series of substantially identical claim tag assemblies such that said identifiers are unique to each of said claim tag assemblies.

* * * * *